US010130126B2

(12) United States Patent
Blauser et al.

(10) Patent No.: US 10,130,126 B2
(45) Date of Patent: Nov. 20, 2018

(54) MIC CORD ACCESS SYSTEM

(71) Applicant: Honeywell International Inc., Morris Plains, NJ (US)

(72) Inventors: Katherine Elizabeth Blauser, Columbus, OH (US); Michelle Vicory, New Carlisle, OH (US)

(73) Assignee: Honeywell International Inc., Morris Plains, NJ (US)

( * ) Notice: Subject to any disclaimer, the term of this patent is extended or adjusted under 35 U.S.C. 154(b) by 213 days.

(21) Appl. No.: 14/887,681

(22) Filed: Oct. 20, 2015

(65) Prior Publication Data

US 2016/0113333 A1 Apr. 28, 2016

Related U.S. Application Data

(60) Provisional application No. 62/067,174, filed on Oct. 22, 2014.

(51) Int. Cl.

| | |
|---|---|
| ***A41D 1/02*** | (2006.01) |
| ***A41D 1/00*** | (2018.01) |
| ***A62B 17/00*** | (2006.01) |
| ***A41D 27/20*** | (2006.01) |

(52) U.S. Cl.

CPC ..... *A41D 1/002* (2013.01); *A41D 27/205* (2013.01); *A62B 17/003* (2013.01)

(58) Field of Classification Search

CPC ..... A41D 27/205; A41D 1/02; A41D 1/002; A41D 1/005; A41D 3/00; A41D 3/02; A41D 27/20; A41D 13/0012; A41D 29/00

See application file for complete search history.

(56) References Cited

U.S. PATENT DOCUMENTS

| | | | | |
|---|---|---|---|---|
| 2,505,551 | A * | 4/1950 | Knowles | H04R 25/04 381/319 |
| 3,114,105 | A * | 12/1963 | Neumiller | H04R 1/10 379/430 |
| 3,925,839 | A * | 12/1975 | Smith | B63C 9/093 2/2.15 |
| 7,364,491 | B2 * | 4/2008 | Updyke | A41C 3/0035 2/247 |
| 8,411,891 | B2 * | 4/2013 | Del Prete | H04R 1/1033 2/905 |
| 9,122,082 | B2 * | 9/2015 | Abreu | G02C 3/003 |
| 9,144,256 | B2 * | 9/2015 | Gheneva | A41D 27/205 |
| 9,242,093 | B1 * | 1/2016 | Sherman | A61N 1/36032 |
| 9,282,392 | B2 * | 3/2016 | Ushakov | H04R 1/1033 |
| 9,504,283 | B2 * | 11/2016 | Gheneva | A41D 27/205 |

(Continued)

*Primary Examiner* — Bobby Muromoto, Jr.

(74) *Attorney, Agent, or Firm* — Wood, Phillips, Katz, Clark & Mortimer

(57) ABSTRACT

A mic cord access system (10) is provided in a firefighter coat (14) having a storm flap (12). The system (10) includes a pocket (24) in the coat (14) and configured to enclose a radio (18) carried in an interior of the pocket (24), the pocket (24) including a notch (22) configured to allow a mic cord (16) to extend from the interior of the pocket (24), an opening (27) adjacent the notch (22) and configured to allow a mic cord (16) to extend from the notch (22) to an interior side (32) of the storm flap (12), and an interior mic mount (30) on the interior side (32) of the storm flap (12) and configured to hold a mic (20) with the storm flap (12) in a closed position.

20 Claims, 1 Drawing Sheet

(56) References Cited

U.S. PATENT DOCUMENTS

2001/0012373 A1* 8/2001 Graumann ..... H04R 5/023 381/364
2002/0197960 A1* 12/2002 Lee ..... A41D 1/005 455/66.1
2003/0144039 A1* 7/2003 Lin ..... A41D 1/005 455/575.2
2005/0246823 A1* 11/2005 Groom ..... A41D 27/205 2/247
2006/0162041 A1* 7/2006 Tengbom ..... A41D 3/00 2/85
2007/0067889 A1* 3/2007 Spiewak ..... A41D 1/002 2/69
2007/0261703 A1* 11/2007 Gheneva ..... A41D 27/205 131/231
2008/0032600 A1* 2/2008 Updyke ..... A41C 3/0035 450/89
2008/0045100 A1* 2/2008 Dungan ..... B63C 9/20 441/89
2009/0094725 A1* 4/2009 Smith ..... A41D 27/205 2/69
2009/0313748 A1* 12/2009 Guedes Lopes Da Fonseca ..... G06F 1/163 2/458
2010/0078457 A1* 4/2010 Pitchford ..... A42B 1/048 224/576
2012/0005801 A1* 1/2012 Parr ..... A41D 3/08 2/84
2012/0070028 A1* 3/2012 Margulies ..... H04R 1/105 381/380
2012/0080126 A1* 4/2012 Marcin ..... A45F 3/14 150/109
2012/0201412 A1* 8/2012 Del Prete ..... H04R 1/1033 381/374
2013/0318680 A1* 12/2013 Keathley ..... A41D 3/00 2/94
2015/0374056 A1* 12/2015 Gheneva ..... A41D 27/205 2/85
2016/0113333 A1* 4/2016 Blauser ..... A41D 1/002 2/96
2016/0227311 A1* 8/2016 Ushakov ..... H04R 1/1033
2016/0242474 A1* 8/2016 Baschak ..... A41D 13/0015
2016/0262463 A1* 9/2016 Keathley ..... A41D 3/00
2016/0366990 A1* 12/2016 Smith ..... H04R 1/028

* cited by examiner

MIC CORD ACCESS SYSTEM

CROSS-REFERENCE TO RELATED APPLICATIONS

This application claims priority to U.S. Provisional Application Ser. No. 62/067,174, filed Oct. 22, 2014, the entire disclosure which is incorporated herein by reference.

FEDERALLY SPONSORED RESEARCH OR DEVELOPMENT

Not Applicable.

MICROFICHE/COPYRIGHT REFERENCE

Not Applicable.

FIELD

This disclosure relates to protective garments and associated equipment for use in firefighting, and more particularly, to protective garments in the form of firefighting coats, and radios and associated microphones (mics) and mic cords used by firefighters.

BACKGROUND

It is known for firefighters to carry a radio on their person for purposes of communication, and for the radio to include a microphone (mic) that is connected to a main body of the radio by a mic cord. Problems can occur when this equipment is exposed to the harsh environments encountered by a firefighter, particularly the harsh thermal environments encountered by firefighters.

SUMMARY

In accordance with one feature of this disclosure, a mic cord access system is provided in a firefighter coat having a stormflap extending vertically over a torso portion of the coat and having an open position and a closed position. The mic cord access system includes: a pocket in the coat and configured to enclose a radio carried in an interior of the pocket, the pocket including a notch configured to allow a mic cord to extend from the interior of the pocket to an exterior of the pocket; an opening in the stormflap adjacent the notch and configured to allow a mic cord to extend from the notch to an interior side of the stormflap; and an interior mic mount on the interior side of the stormflap and configured to hold a mic with the stormflap in the closed position.

As one feature, the pocket is located on a lower half of the coat.

In one feature, the interior mic mount is located in an upper half of the stormflap.

As one feature, the interior mic mount is a mic mount tab.

According to one feature, the opening in the stormflap includes a releasable fastener that allows the opening to be selectively moved between an open condition wherein a mic cord can be placed on the interior side of the storm flap while extending from the notch and a closed condition wherein the opening is closed with a mic cord extending from the notch to the interior side of the stormflap.

In one feature, the releasable fastener is a hook and loop closure.

As one feature, the opening further includes a closure mechanism adjacent a lower portion of the opening. In a further feature, the closure mechanism is one of a bartack or snap.

According to one feature, the system further includes an exterior mic mount located on an exterior of the coat and configured to hold a mic with a mic cord of the mic extending from the interior side of the stormflap to the exterior of the coat.

In one feature, the exterior mic mount is a mic mount tab.

As one feature, the exterior mic mount is located on an upper half of an exterior of the coat.

According to one feature, the pocket is located on a lower half of the coat and the interior mic mount is located in an upper half of the stormflap. In a further feature, the system further includes an exterior mic mount located on an exterior of the coat and configured to hold a mic with a mic cord of the mic extending from an interior side of the stormflap to the exterior of the coat. In yet a further feature, the exterior mic mount is located on an upper half of an exterior of the coat. As a further feature, the exterior mic mount is a mic mount tab.

In one feature, the pocket is located on a lower half of the coat; the mic mount is located in an upper half of the stormflap; and the opening in the stormflap includes a releasable fastener that allows the opening to be selectively moved between an open condition wherein a mic cord can be placed on the interior side of the storm flap while extending from the notch and a closed condition wherein the opening is closed with a mic cord extending from the notch to the interior side of the stormflap. In a further feature, the releasable fastener is a hook and loop closure. In yet a further feature, the opening further includes a closure mechanism adjacent a lower portion of the opening. As a further feature, the closure mechanism is one of a bartack or snap. In an additional feature, the system further includes an exterior mic mount located on an exterior of the coat and configured to hold a mic with a mic cord of the mic extending from the interior side of the stormflap to the exterior of the coat.

Other features and advantages will become apparent from a review of the entire specification, including the appended claims and drawings.

DETAILED DESCRIPTION

Figure 1:
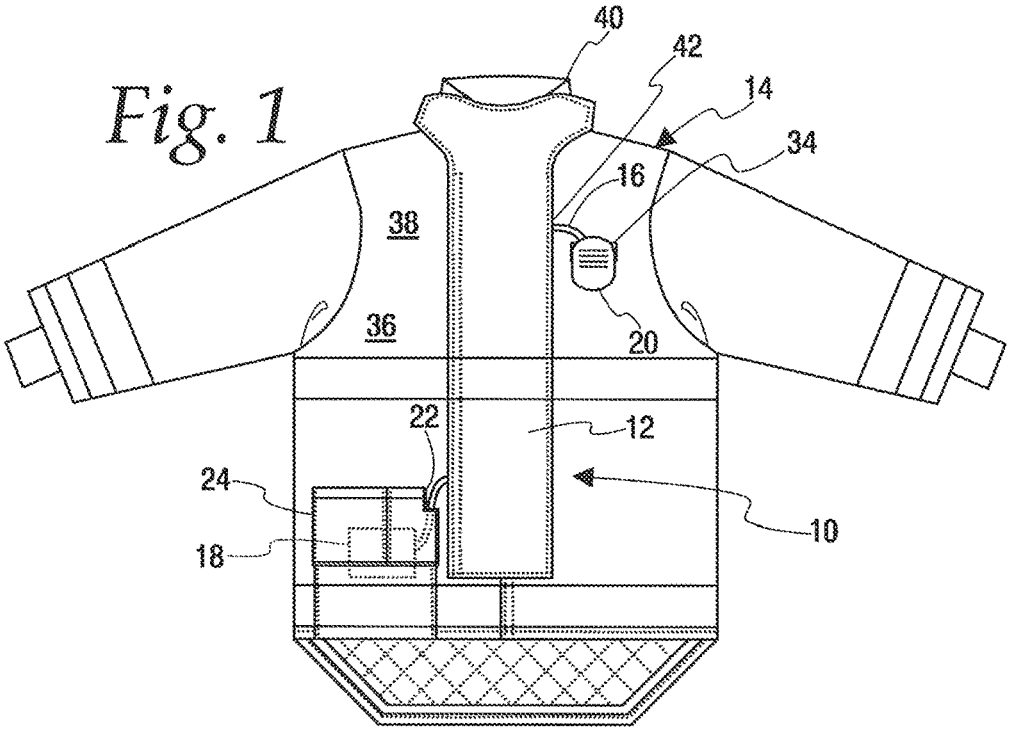
FIG. 1 is a somewhat diagrammatic representation of a firefighter coat including a mic cord access system according to this disclosure, with a stormflap of the firefighter coat shown in a closed position, an opening in the stormflap for the mic cord access system shown in a closed condition, a radio stored within the pocket, and a mic cord extending from a notch in the pocket through the opening in the stormflap to the inside/underside of the stormflap and up to a mic mounted on an exterior of the firefighter coat.

The mic cord access system 10 disclosed herein will eliminate the need for a separate mic cord protection device by utilizing the existing thermal protection properties inherently found in the "shield" or "stormflap" 12 of a firefighting coat 14.

The Mic Cord Access System 10 solves the current problem of the mic cord 16 (the cord running from the radio 18 to the microphone 20) being damaged or destroyed while a firefighter is on active duty.

Figure 2:
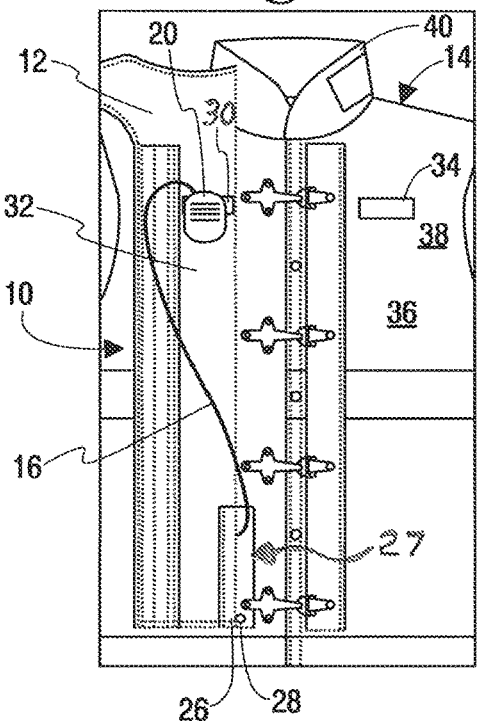
FIG. 2 is a slightly enlarged view of a portion of FIG. 1, showing the stormflap in an open condition and a mic stowed on an interior side of the stormflap with the mic cord extending through the opening in the stormflap and on the interior of the stormflap up to the mic.

Unique or Novel features include:

Corner Notch 22 at top edge of bellow pocket 24 to adjust radio 18 and thread mic cord 16 out of pocket 24, as best seen in FIGS. 1 and 2.

Figure 3:
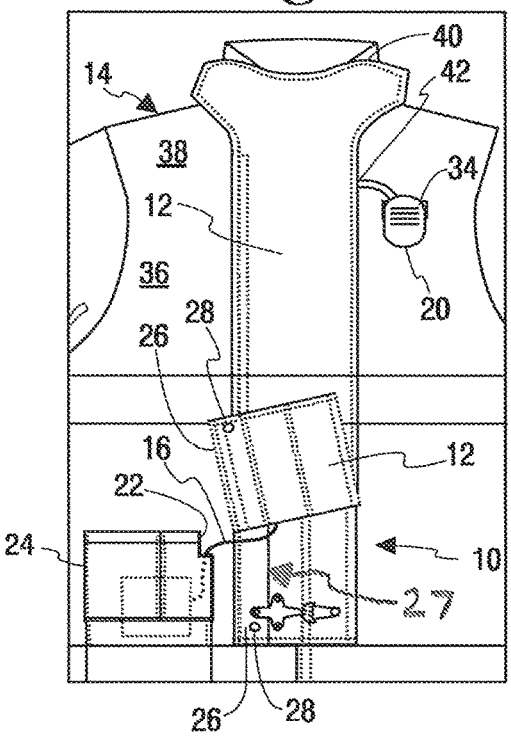
FIG. 3 is a view similar to FIG. 2, but showing the stormflap in a closed position, the mic carried on an exterior of the firefighter coat, and the opening in the stormflap in an open condition, again with the mic cord extending from the notch in the pocket to the inside of the stormflap and then up to the mic.

6 ½" of mating hook & loop Velcro 26 set on stormflap or shield 12 nearest to the corner notch 22 for closing an opening 27 in the storm flap that allows the mic cord 16 to extend from the notch 22 to under the shield/stormflap 12, as best seen in FIGS. 2 and 3.

The option of a closure mechanism 28 at base of velcro, either a bartack or snap 28, as best seen in FIGS. 2 and 3.

Stowing mic mount tab 30 on interior 32 of the shield 12 for placement of the microphone 20 when not in use, as best seen in FIG. 2.

Exterior mic mount tab 34 on chest 36, upper chest 38 or collar position 40 of the exterior of the coat 14 for placement of the microphone 20 during active duty, as best seen in FIGS. 1 and 3.

The cord 16 will run under the shield stormflap 12 from the bellow pocket notch 22 to an exit point 42 nearest to the exterior mic mount tab 34.

The invention claimed is:

1. A mic cord access system in a firefighter coat having a stormflap extending vertically over a torso portion of the coat and having an open position and a closed position, the system comprising:

a pocket in the coat and configured to enclose a radio carried in an interior of the pocket, a notch opening in the pocket configured to allow a mic cord to pass from the interior of the pocket to an exterior of the pocket and the coat adjacent the pocket;

an opening in the stormflap adjacent the notch opening and configured to allow a mic cord to extend from the exterior of the coat notch opening to an interior side of the stormflap; and an interior mic mount on the exterior of the coat and the interior side of the stormflap and configured to hold a mic with the stormflap in the closed position.

2. The system of claim 1 wherein the pocket is located on a lower half of the coat.

3. The system of claim 1 wherein the interior mic mount is located in an upper half of the stormflap.

4. The system of claim 1 wherein the opening in the stormflap includes a releasable fastener that allows the opening to be selectively moved between an open condition wherein a mic cord can be placed on the interior side of the storm flap while extending from the notch and a closed condition wherein the opening is closed with a mic cord extending from the notch to the interior side of the stormflap.

5. The system of claim 4 wherein the releasable fastener is a hook and loop closure.

6. The system of claim 4 the opening further comprises a closure mechanism adjacent a lower portion of the opening.

7. The system of claim 6 wherein the closure mechanism is one of a bartack or snap.

8. A mic cord access system in a firefighter coat having a stormflap extending vertically over a torso portion of the coat and having an open position and a closed position, the system comprising:

a pocket in the coat and configured to enclose a radio carried in an interior of the pocket, a notch opening in the pocket configured to allow a mic cord to pass from the interior of the pocket to an exterior of the pocket and the coat adjacent the pocket;

an opening in the stormflap adjacent the notch opening and configured to allow a mic cord extend from the notch opening to an interior side of the stormflap; and an interior mic mount on the exterior of the coat and the interior side of the stormflap and configured to hold a mic with the stormflap in the closed position; and an exterior mic mount located on an exterior of the coat and configured to hold a mic with a mic cord of the mic extending from the interior side of the stormflap to the exterior of the coat.

9. The system of claim 8 wherein the exterior mic mount is a mic mount tab.

10. The system of claim 9 wherein the exterior mic mount is located on an upper half of an exterior of the coat.

11. The system of claim 1 wherein the pocket is located on a lower half of the coat and the interior mic mount is located in an upper half of the stormflap.

12. A mic cord access system in a firefighter coat having a stormflap extending vertically over a torso portion of the coat and having an open position and a closed position, the system comprising:

a pocket in the coat and configured to enclose a radio carried in an interior of the pocket, a notch opening in the pocket configured to allow a mic cord to pass from the interior of the pocket to an exterior of the pocket and the coat adjacent the pocket;

an opening in the stormflap adjacent the notch opening and configured allow a mic cord to extend from the notch opening to an interior side of the stormflap; and an interior mic mount on the exterior of the coat and the interior side of the stormflap and configured to hold a mic with the stormflap in the closed position; and wherein the interior mic mount is a mic mount tab.

13. The system of claim 11 further comprising an exterior mic mount located on an exterior of the coat and configured to hold a mic with a mic cord of the mic extending from an interior side of the stormflap to the exterior of the coat.

14. The system of claim 13 wherein the exterior mic mount is located on an upper half of an exterior of the coat.

15. The system of claim 13 wherein the exterior mic mount is a mic mount tab.

16. The system of claim 1 wherein:

the pocket is located on a lower half of the coat;

the mic mount is located in an upper half of the stormflap; and the opening in the stormflap includes a releasable fastener that allows the opening to be selectively moved between an open condition wherein a mic cord can be placed on the interior side of the storm flap while extending from the notch and a closed condition wherein the opening is closed with a mic cord extending from the notch to the interior side of the stormflap.

17. The system of claim 16 wherein the releasable fastener is a hook and loop closure.

18. The system of claim 17 the opening further comprises a closure mechanism adjacent a lower portion of the opening.

19. The system of claim 18 wherein the closure mechanism is one of a bartack or snap.

20. The system of claim 19 further comprising an exterior mic mount located on an exterior of the coat and configured to hold a mic with a mic cord of the mic extending from the interior side of the stormflap to the exterior of the coat.

* * * * *